US010466605B2

(12) United States Patent
Sato et al.

(10) Patent No.: US 10,466,605 B2
(45) Date of Patent: Nov. 5, 2019

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Narumasa Sato, Kanagawa (JP); Kotaro Yoshihara, Kanagawa (JP); Daisuke Ishizuka, Kanagawa (JP); Takahisa Tatekawa, Kanagawa (JP); Noriyuki Mizutani, Kanagawa (JP); Erina Saito, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/893,065

(22) Filed: Feb. 9, 2018

(65) Prior Publication Data

US 2018/0275541 A1 Sep. 27, 2018

(30) Foreign Application Priority Data

Mar. 24, 2017 (JP) ..... 2017-058887

(51) Int. Cl.

*G03G 9/08* (2006.01)
*G03G 9/097* (2006.01)
*G03G 9/087* (2006.01)

(52) U.S. Cl.

CPC ..... *G03G 9/0819* (2013.01); *G03G 9/0821* (2013.01); *G03G 9/08755* (2013.01); *G03G 9/08782* (2013.01); *G03G 9/09716* (2013.01); *G03G 9/09725* (2013.01)

(58) Field of Classification Search

CPC . G03G 9/087; G03G 9/08755; G03G 9/09725
See application file for complete search history.

(56) References Cited

U.S. PATENT DOCUMENTS

2008/0057430 A1* 3/2008 Takahashi ..... G03G 9/0819 430/109.4
2010/0055595 A1* 3/2010 Shirai ..... G03G 9/0804 430/109.4
2011/0300478 A1* 12/2011 Sekikawa ..... G03G 9/0804 430/108.1
2016/0313661 A1* 10/2016 Sekiguchi ..... G03G 9/09733

FOREIGN PATENT DOCUMENTS

JP 2016-95384 A * 5/2016
JP 2017-3844 A 1/2017

OTHER PUBLICATIONS

Machine Translation of JP2016-95384A, May 2016, pp. 1-12.*

* cited by examiner

*Primary Examiner* — Thorl Chea
(74) *Attorney, Agent, or Firm* — Sughrue Mion, PLLC

(57) ABSTRACT

An electrostatic charge image developing toner includes toner particles that contain a polyester resin which includes a condensed polymer of a polyvalent carboxylic acid and a polyol which contains ethylene glycol in an amount of from about 40% by weight to about 90% by weight with respect to a total amount of the polyol, and an external additive that contains silica particles in which a product of a volume average particle diameter D50 (nm) and a BET specific surface area SA ($m^2/g$) is from about $1.4\times10^3$ to about $5.0\times10^3$.

19 Claims, 2 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2017-058887 filed Mar. 24, 2017.

BACKGROUND

1. Technical Field

The present invention relates to an electrostatic charge image developing toner, an electrostatic charge image developer, and a toner cartridge.

2. Related Art

A method of visualizing image information such as an electrophotographic method is used in various technical fields in recent years. In the electrophotographic method, an electrostatic charge image is formed on a surface of an image holding member as image information through charging and electrostatic charge image forming. In addition, a toner image is formed on the surface of the image holding member with a developer containing toner, then the toner image is transferred to a recording medium, and the toner image is fixed on the recording medium. Through these steps, the image information is visualized as an image.

SUMMARY

According to an aspect of the invention, there is provided an electrostatic charge image developing toner including:

toner particles that contain a polyester resin which includes a condensed polymer of a polyvalent carboxylic acid and a polyol which contains ethylene glycol in an amount of from about 40% by weight to about 90% by weight with respect to a total amount of the polyol; and an external additive that contains silica particles in which a product of a volume average particle diameter D50 (nm) and a BET specific surface area SA ($m^2/g$) is from about $1.4\times10^3$ to about $5.0\times10^3$.

BRIEF DESCRIPTION OF THE DRAWINGS

Exemplary embodiments of the present invention will be described in detail based on the following figures, wherein.

DETAILED DESCRIPTION

Figure 1:
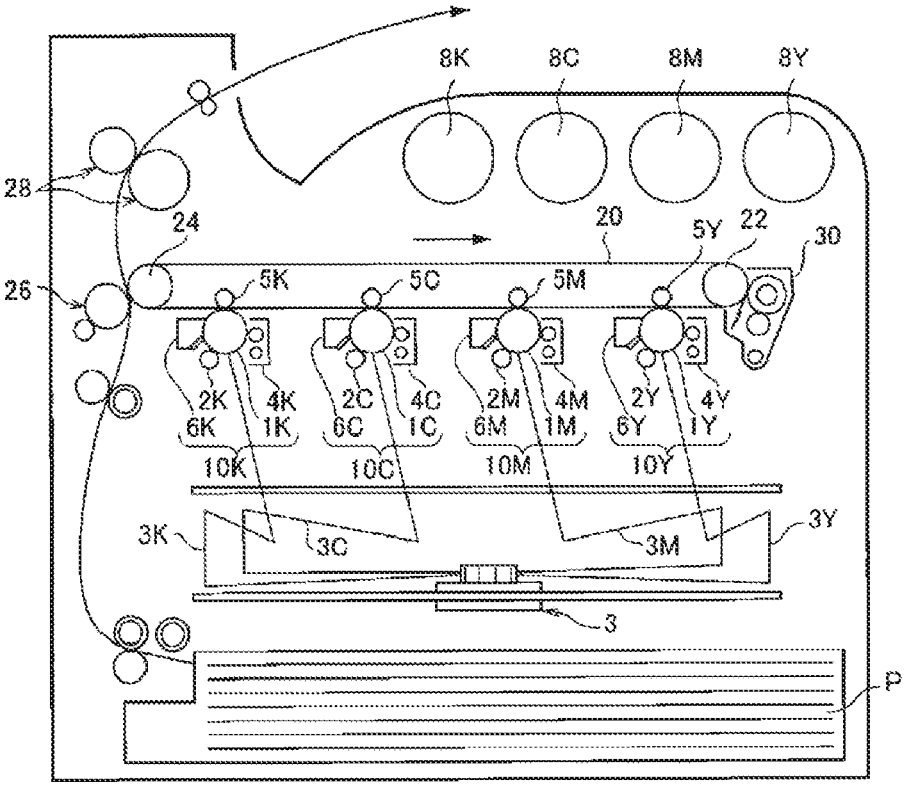
FIG. 1 is a configuration diagram illustrating an example of an image forming apparatus according to the exemplary embodiment.

Hereinafter, the exemplary embodiment which is an example of the invention will be described in detail. Electrostatic charge image developing toner An electrostatic charge image developing toner (hereinafter, referred to as a "toner") according to the exemplary embodiment includes toner particles, and an external additive.

Toner particles contain a polyester resin which includes a condensed polymer of polyvalent carboxylic acid and polyol, and in which the polyol contains ethylene glycol, and a weight ratio of the ethylene glycol to the entire polyol is from 40% by weight or about 40% by weight to 90% by weight or about 90% by weight.

The external additive include silica particles in which a product of the volume average particle diameter D50 (nm) and a BET specific surface area SA ($m^2/g$) is from $1.4\times10^3$ or about $1.4\times10^3$ to $5.0\times10^3$ or about $5.0\times10^3$.

With such a configuration, the toner according to the exemplary embodiment prevents the occurrence of a dog ear (a phenomenon in which an edge of the recording medium is folded) which occurs when forming an image on a back surface of a recording medium after forming an image with a small edge margin on one surface of the recording medium kept under a high temperature and high humidity environment. The reason for this is presumed as follows.

In this regard, when the recording medium (hereinafter, also referred to as "paper") is kept under the high temperature and high humidity environment (for example, under the environment of 28° C. and 85% RH), the paper is moistened (moisture absorbed). When an image with a small edge margin is formed on one surface of a paper containing water (that is, an image present up to the edge portion on the downstream side in the paper supplying direction or near the edge portion: for example, an image having an edge margin width of within 3 mm), only the one surface side of the paper is heated at the time of fixing, and thus, the moisture evaporates from the paper and warping of the paper occurs. Particularly, in a case where an image without an edge margin, a force which causes the image formed on the edge portion of the paper to be wound around a member of a fixing unit acts (for example, a fixing roller), and thus the warping of the paper is likely to occur.

In this state, when an image is formed on the back surface of the paper, a phenomenon (dog ear) in which the edge of the warped paper contacts a member of the fixing unit (for example, the fixing roller), thereby folding the edge of the paper.

In contrast, a polyester resin including ethylene glycol, which easily holds moisture as a polyol, in a range from 40% by weight to 90% by weight with respect to the total amount of the polyol, is used as a binder resin of toner particles. In addition, as the external additive, silica particles in which a product of the volume average particle diameter D50 (nm) and the BET specific surface area SA ($m^2/g$) is from $1.4\times10^3$ to $5.0\times10^3$ are used.

With such a configuration, when fixing a toner image, the toner contains a large amount of moisture, and thus heat transference to the paper is prevented by the toner image. For this reason, even if an image with less edge margin is formed on one surface of the paper, moisture is hardly evaporated from the paper, and warping of the paper hardly occurs.

Therefore, even if an image is formed on the back surface of the paper thereafter, the edge of the paper is unlikely to contact the member (for example, the fixing roller) of the fixing unit, thereby preventing the phenomenon in which the edge of the paper is folded (dog ear).

With such a configuration described above, it is presumed that the toner according to the exemplary embodiment prevents the dog ear (the phenomenon in which the edge of the recording medium is folded) which occurs when forming an image on a back surface of a recording medium after forming an image with a small edge margin on one surface of the recording medium kept under a high temperature and high humidity environment.

Here, from the viewpoint of preventing a moisture amount in the paper evaporated at the time of the fixing and preventing the paper from being warped, the moisture rate of the toner after being kept for 24 hours under the environment of 28° C. and 85% RH is preferably from 3% or about 3% by weight to 8% or about 8% by weight, and is further preferably from 4% or about 4% by weight to 6% or about 6% by weight.

In addition to adjustment of the use amount of ethylene glycol of the polyester resin, examples of a method of making the moisture rate of the toner within the above range include a method of externally adding the external additive having a high moisture holding rate and a method of reducing the heat amount at the time of drying the toner particles.

The moisture rate of the toner is measured by the following method.

First, a toner containing the external additive to be measured is kept for 24 hours under the environment of 28° C. and 85% RH. Specifically, a small amount of toner (approximately 5 g) is put into a polyethylene bag, and a mouth of the bag is opened and kept.

Next, with respect to the toner after being kept, the moisture rate of the toner is measured by a constant voltage polarization voltage titration method using a Karl Fischer titrator. For example, the moisture rate of the toner is measured by a volumetric titration type moisture measuring device KF-06 manufactured by Mitsubishi Kasei Corporation. That is, 10 μl of pure water is precisely weighed with a micro syringe, and the moisture (mg) per 1 ml of Karl Fischer reagent is calculated by the reagent titration amount necessary for removing the pure water. Subsequently, the measurement sample is precisely weighed in a range from 100 mg to 200 mg, and is thoroughly dispersed with a magnetic stirrer for ten minutes in a measurement flask. After dispersion, the measurement is started, the titration amount (ml) of the Karl Fischer reagent required for titration is integrated, and the moisture amount and the moisture rate are calculated by the following Expression. Note that, the Karl Fischer moisture rate is indicated with the moisture rate.

$$\text{Moisture amount (mg)} = \text{reagent consumption (ml)} \times \text{reagent titer (mgH}_2\text{O/ml)}$$

$$\text{Moisture rate (\%)} = [\text{moisture amount (mg)}/\text{sample amount (mg)}] \times 100$$

In this manner, the moisture rate of the toner is measured.

In addition, from the viewpoint of improving the releasability of the toner layer at the time of fixing and preventing the paper from being warped, in the toner according to the exemplary embodiment, the toner particles contain a release agent, and 70% or more or about 70% or more (preferably 80% or more, and particularly preferably 100%) of the entire release agent may be present within 800 nm from the surface of the toner particle. Note that, the existence ratio of the release agent existing within 800 nm from the surface of this toner particle is referred to as "release agent abundance".

When the release agent abundance is set to be within the above range, and the release agents are unevenly distributed on the surface layer of the toner particle, the release agent easily bleeds at the time of fixing the toner image. With this, when an image without the edge margin is formed on one surface of the paper, the releasability of "the image formed on the edge portion of the paper" with respect to the member (for example, the fixing roller) of the fixing unit is improved, and the force which causes the image formed on the edge portion of the paper to be wound around a member of the fixing unit (for example, the fixing roller) acts. Therefore, the paper is prevented from being warped, and thus is less likely to occur. After that, even when the image is formed on the back surface of the paper, the edge of the paper hardly contacts the member (for example, the fixing roller) of the fixing unit, and the occurrence of the phenomenon (dog ear) that the edge of the paper is folded is likely to be prevented is likely to be prevented.

An average diameter of domains of the release agent (hereinafter, also referred to as a "domain diameter") is from 0.3 μm or about 0.3 μm to 0.8 μm or about 0.8 μm, and from the viewpoint of from the viewpoint of improving the releasability of the toner layer at the time of fixing and preventing the paper from being warped, is preferably from 0.3 μm or about 0.3 μm to 0.7 μm or about 0.7 μm, and is further preferably from 0.3 μm or about 0.3 μm to 0.5 μm or about 0.5 μm.

Here, a method of measuring the release agent abundance and the domain diameter (the average diameter of domains) of the release agent will be described.

Samples and images for measurement are prepared by the following method.

The toner is mixed into and embedded in an epoxy resin, and the epoxy resin is solidified. The obtained solidified matter is cut with an ultramicrotome device (Ultracut UCT manufactured by Leica) to prepare a thin sample having a thickness in a range of 80 nm to 130 nm. Next, the obtained slice sample is dyed with ruthenium tetroxide for 3 hours in a desiccator at 30° C. In addition, an SEM image of the dyed slice sample is obtained by using an ultrahigh resolution field emission scanning electron microscope (FE-SEM, S-4800 manufactured by Hitachi High-Technologies Corporation). Since the release agent and the polyester resin tend to be dyed by ruthenium tetroxide in order, each component is identified by light and shade due to the degree of dyeing. In a case where it is difficult to distinguish the light and shade due to the sample conditions, the dyeing time is adjusted.

Note that, in a cross-section of the toner particle, a domain of a coloring agent is smaller than the domain of the release agent, and thus the coloring agent and the release agent may be distinguished from each other by the size. In addition, the domain of the coloring agent may be also distinguished from the domain of the release agent by the light and shade of dyeing.

The release agent abundance is a value measured by the following method.

In the SEM image, a toner particle cross-section in which the maximum length is equal to or greater than 85% of the volume average particle diameter of the toner particles is selected, the domain of the dyed release agent is observed, the area of the release agent of the entire toner particle and the area of the release agent existing in the region within 1,000 nm from the surface of the toner particle is obtained, and the ratio of both areas (the area of the release agent existing in the region within 1,000 nm from the surface of the toner particles/the area of the release agent with respect to the entire toner particles) is calculated. In addition, this calculation is performed for 100 toner particles, and the average value thereof is set as the release agent abundance.

The reason for selecting the toner particle cross-section in which the maximum length is equal to or greater than 85% of the volume average particle diameter of the toner particles is that the cross-section with the volume average particle diameter of less than 85% is expected to be a cross-section of the end of the toner particle, and the cross-section of the end of the toner particles does not reflect the state of the domains in the toner particle well.

The domain diameter (average diameter of domains) of the release agent is a value measured by the following method.

In the SEM image, 30 toner particle cross-sections in which the maximum length is equal to or greater than 85% of the volume average particle diameter of the toner particles are selected, 100 domains in total of the dyed release agents are observed. The maximum length of each domain is measured, the maximum length is set as a diameter of the domain, and an arithmetic average thereof is set as an average diameter.

As a method of controlling the release agent abundance to be equal to or greater than 70%, for example, a method of using the release agent only in forming a shell layer is formed in the preparing of the toner particles is exemplified.

The average diameter of the domains of the release agent may be controlled by, for example, preparing the toner particles by an aggregation and coalescence method and adjusting the volume average particle diameter of the release agent particles contained in the release agent particle dispersion used at the time of the preparation; and by preparing plural release agent particle dispersions having different volume average particle diameters, and using the release agent particle dispersions in combination.

Hereinafter, the toner according to the exemplary embodiment will be described in detail.

The toner according to the exemplary embodiment includes toner particles. The toner includes an external additive externally added to the toner particles.

Toner Particles

The toner particles contain a binder resin. The toner particles may contain a coloring agent, a release agent, and other additives.

Binder Resin

As the binder resin, a polyester resin is applied. The ratio of the polyester resin with respect to the entire binder resins may be, for example, 85% by weight or more or about 85% by weight or more, is preferably 95% by weight or more, and is further preferably 100% by weight.

As the polyester resin, a polyester resin which includes a condensed polymer of a polyvalent carboxylic acid and a polyol which contains ethylene glycol at a weight ratio of 40% by weight to 90% by weight to the total amount of the polyol is applied.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acid (for example, cyclohexane dicarboxylic acid), aromatic dicarboxylic acid (for example, terephthalic acid, isophthalic acid, phthalic acid, and naphthalene dicarboxylic acid), an anhydride thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, tri- or higher-valent carboxylic acid employing a crosslinked structure or a branched structure may be used in combination with dicarboxylic acid. Examples of the tri- or higher-valent carboxylic acid include trimellitic acid, pyromellitic acid, anhydrides thereof, or lower alkyl esters (having, for example, 1 to 5 carbon atoms) thereof.

The polyvalent carboxylic acids may be used singly or in combination of two or more kinds thereof.

As the polyol, at least ethylene glycol is applied.

Here, the weight ratio of ethylene glycol with respect to the entirety of the polyol is from 40% by weight to 90% by weight, and from the viewpoint of controlling the evaporated moisture amount from the paper at the time of the fixing by setting the moisture rate of the toner to be within the above range, and preventing the paper from being warped, the weight ratio is preferably from 50% by weight to 80% by weight, and is further preferably from 60% by weight to 70% by weight.

Note that, in a case where two or more kinds of polyester resins in which polyol having different weight ratio of ethylene glycol with respect to the entire polyol is used are used in combination, the weight ratio of the ethylene glycol with respect to the entire polyol is as follows, for example. For example, in a case where two or more kinds of polyester resins in which polyol having different weight ratio of ethylene glycol with respect to the entire polyol is used are used in combination, when the weight ratio of ethylene glycol in a polyester resin A is set as A1, the weight ratio of the polyester resin A occupied in the entire polyester resins in the toner particles is set as A2, the weight ratio of ethylene glycol in a polyester resin B is set as B1, and the weight ratio of the polyester resin B occupied in the entire polyester resin in the toner particles is set as B2, the weight ratio of ethylene glycol with respect to the entire polyol employs a value calculated from Expression: $A1 \times A2 + B1 \times B2$. Even in a case where three or more kinds of the polyester resins are used in combination, the weight ratio of ethylene glycol with respect to the entire polyol is calculated with the same manner.

Examples of other polyols in addition to ethylene glycol include aliphatic diol other than ethylene glycol (for example, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A, and a propylene oxide adduct of bisphenol A). Among these, for example, aromatic diols and alicyclic diols are preferably used, and aromatic diols are more preferably used as the polyol.

As other polyols, a tri- or higher-valent polyol employing a crosslinked structure or a branched structure may be used in combination together with diol. Examples of the tri- or higher-valent polyol include glycerin, trimethylolpropane, and pentaerythritol.

The polyol may be used singly or in combination of two or more types thereof.

Here, as other polyols, from the viewpoint of preventing the dog ear by setting the moisture rate of the toner to be within the above range, aliphatic diol other than ethylene glycol, and alicyclic diol are preferable, and aliphatic diol (aliphatic diol having 3 to 6 carbon atoms) other than ethylene glycol are further preferable, and neopentyl glycol is particularly preferable.

Note that, as other polyols, polyol except for polyol having a bisphenol (particularly, bisphenol A) structure may be applied.

The glass transition temperature (Tg) of the polyester resin is preferably from 50° C. to 80° C., and further preferably from 50° C. to 65° C.

The glass transition temperature is obtained from a DSC curve obtained by differential scanning calorimetry (DSC). More specifically, the glass transition temperature is obtained from "extrapolated glass transition onset temperature" described in the method of obtaining a glass transition temperature in JIS K 7121-1987 "testing methods for transition temperatures of plastics".

The weight average molecular weight (Mw) of the polyester resin is preferably from 5,000 to 1,000,000, and is further preferably from 7,000 to 500,000.

The number average molecular weight (Mn) of the polyester resin is preferably from 2,000 to 100,000.

The molecular weight distribution Mw/Mn of the polyester resin is preferably from 1.5 to 100, and is further preferably from 2 to 60.

The weight average molecular weight and the number average molecular weight are measured by gel permeation chromatography (GPC). The molecular weight measurement by GPC is performed using GPC.HLC-8120 GPC, manufactured by Tosoh Corporation as a measuring device, Column TSK gel Super HM-M (15 cm), manufactured by Tosoh Corporation, and a THF solvent. The weight average molecular weight and the number average molecular weight are calculated by using a molecular weight calibration curve plotted from a monodisperse polystyrene standard sample from the results of the foregoing measurement.

A known preparing method is used to prepare the polyester resin. Specific examples thereof include a method of conducting a reaction at a polymerization temperature set to be in a range from 180° C. to 230° C., if necessary, under reduced pressure in the reaction system, while removing water or an alcohol generated during condensation.

In a case where of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. In a case where a monomer having poor compatibility is present, the monomer having poor compatibility and an acid or an alcohol to be polycondensed with the monomer may be previously condensed and then polycondensed with the major component.

As the binder resin, other binder resins may be used in combination.

Examples of the other binder resins include vinyl resins formed of homopolymer of monomers such as styrenes (for example, styrene, para-chloro styrene, and α-methyl styrene), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (for example, acrylonitrile, and methacrylonitrile), vinyl ethers (for example, vinyl methyl ether, and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

As the other binder resins, there are also exemplified non-vinyl resins such as an epoxy resin, a polyester resin (except for a polyester resin using the above-described ethylene glycol), a polyurethane resin, a polyamide resin, a cellulose resin, a polyether resin, and modified rosin, a mixture thereof with the above-described vinyl resins, or a graft polymer obtained by polymerizing a vinyl monomer with the coexistence of such non-vinyl resins.

These other binder resins may be used singly or in combination of two or more types thereof.

The content of the binder resin is, for example, preferably from 40% by weight to 95% by weight, is further preferably from 50% by weight to 90% by weight, and is still further preferably from 60% by weight to 85% by weight with respect to the entire toner particles.

Coloring Agent

Examples of the coloring agent include various kinds of pigments such as Carbon Black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watch Young Red, Permanent Red, Brilliant Carmine 3B, Brilliant Carmine 6B, Dupont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, Malachite Green Oxalate or various kinds of dyes such as acridine dye, xanthene dye, azo dye, benzoquinone dye, azine dye, anthraquinone dye, thioindigo dye, dioxazine dye, thiazine dye, azomethine dye, indigo dye, phthalocyanine dye, aniline black dye, polymethine dye, triphenylmethane dye, diphenylmethane dye, and thiazole dye.

The coloring agents may be used singly or in combination of two or more kinds thereof.

The coloring agent may be a surface-treated coloring agent, if necessary, or may be used in combination with a dispersant. Further, plural kinds of coloring agents may be used in combination.

The content of the coloring agent is, for example, is preferably from 1% by weight to 30% by weight, and is further preferably from 3% by weight to 15% by weight with respect to the entire toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. However, the release agent is not limited to the above examples.

Among them, as the release agent, the hydrocarbon wax (wax having a polymer as a skeleton) is preferable from the viewpoint of preventing the paper from being warped by improving the releasability of the toner layer at the time of the fixing.

Examples of the hydrocarbon wax include synthetic waxes such as Fischer Tropsch wax, polyethylene wax (wax having a polyethylene skeleton), polypropylene wax (wax having a polypropylene skeleton); petroleum waxes such as paraffin wax (wax having a paraffin skeleton) and microcrystalline wax; and the like. Among the hydrocarbon waxes, the paraffin wax is preferable from the viewpoint of improving the releasability of the toner layer at the time of the fixing by setting the moisture rate of the toner to be within the above range, and preventing the paper from being warped. It is considered that a major chain of the polyester resin containing ethylene glycol as a major component and the paraffinic wax have a linear structure with each other and have a similar structure, so that adhesion of an interface between the polyester resin and the paraffinic wax is increased, and thus uneven distribution of moisture in the interface between the polyester resin and the wax is prevented. As a result, it is considered that the wax easily bleeds into the image surface at the time of the fixing, the releasability of the fixed image is enhanced, and the dog ear is likely to be prevented.

Here, the content of the hydrocarbon wax (particularly, paraffin wax) with respect to the release agent may be from 85% by weight to 100% by weight, is preferably from 95% by weight to 100% by weight, and is further preferably 100% by weight.

The melting temperature of the release agent is preferably from 50° C. to 110° C., and is further preferably from 60° C. to 100° C.

Note that, the melting temperature is obtained from a DSC curve obtained by differential scanning calorimetry (DSC), and specifically obtained from "melting peak temperature" described in the method of obtaining a melting temperature in JIS K 7121-1987 "testing methods for transition temperatures of plastics".

The content of the release agent is, for example, preferably from 1% by weight to 20% by weight, and is further preferably from 5% by weight to 15% by weight with respect to the entire toner particles.

Other Additives

Examples of other additives include well-known additives such as a magnetic material, a charge-controlling agent, and an inorganic powder. These additives are contained in the toner particle as internal additives.

Properties and the Like of Toner Particles

The toner particles may be toner particles having a single-layer structure, or toner particles having a so-called core•shell structure composed of a core (core) and a coating layer (shell layer) coated on the core, but is preferably toner particles having the core•shell structure.

Here, from the viewpoint that the release agent abundance is set to be within the above range, the toner particles having a core•shell structure are preferably configured to include a core formed of a binder resin and if necessary, other additives such as a coloring agent, and a coating layer formed of a binder resin and a release agent.

The volume average particle diameter (D50v) of the toner particles is preferably from 2 μm to 10 μm, and is further preferably from 4 μm to 8 μm.

Various average particle diameters and various particle diameter distribution indices of the toner particles are measured using a Coulter Multisizer II (manufactured by Beckman Coulter, Inc.) and ISOTON-II (manufactured by Beckman Coulter, Inc.) as an electrolyte.

In the measurement, 0.5 mg to 50 mg of a measurement sample is added to 2 ml of a 5% aqueous solution of surfactant (preferably sodium alkylbenzene sulfonate) as a dispersant. The obtained material is added to 100 ml to 150 ml of the electrolyte.

The electrolyte in which the sample is suspended is subjected to a dispersion treatment using an ultrasonic disperser for 1 minute, and a particle diameter distribution of particles having a particle diameter of from 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle diameter ranges (channels) separated based on the measured particle diameter distribution. The particle diameter when the cumulative percentage becomes 16% is identified as that corresponding to a volume average particle diameter D16v and a number average particle diameter D16p, while the particle diameter when the cumulative percentage becomes 50% is identified as that corresponding to a volume average particle diameter D50v and a number average particle diameter D50p. Furthermore, the particle diameter when the cumulative percentage becomes 84% is identified as that corresponding to a volume average particle diameter D84v and a number average particle diameter D84p.

Using these, a volume average particle diameter distribution index (GSDv) is calculated as $(D84v/D16v)^{1/2}$, while a number average particle diameter distribution index (GSDp) is calculated as $(D84p/D16p)^{1/2}$.

The average circularity of the toner particles is preferably from 0.94 to 1.00, and is preferably from 0.95 to 0.98.

The average circularity of the toner particles is calculated by (circumference length of circle equivalent diameter)/(circumference length) [(circumference length of circle having the same projection area as that of particle image)/(circumference length of particle projected image)]. Specifically, the value is measured by using the following method.

The average circularity of the toner particles is calculated by using a flow particle image analyzer (measured by FPIA-3000 manufactured by Sysmex Corporation) which first, suctions and collects the toner particles to be measured so as to form flake flow, then captures a particle image as a static image by instantaneously emitting strobe light, and then performs image analysis of the obtained particle image. 3,500 particles are sampled at the time of calculating the average circularity.

Since the toner has an external additive, the toner (developer) to be measured is dispersed in water containing a surfactant, and then an ultrasonic treatment is performed so as to obtain toner particles from which external additives have been removed.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O$—$(TiO_2)$ n, $Al_2O_3.2SiO_2$, $CaCO_3$, $MgCO_3$, $BaSO_4$, and $MgSO_4$.

Surfaces of the inorganic particles as an external additive are preferably treated with a hydrophobizing agent. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive include a resin particle (resin particle such as polystyrene, polymethyl methacrylate (PMMA), and melamine resin), a cleaning aid (for example, metal salts of higher fatty acids typified by zinc stearate, and particles having fluorine high molecular weight polymer).

Here, as the external additive according to the exemplary embodiment, silica particles in which a product (D50×SA) of the volume average particle diameter D50 (nm) and a BET specific surface area SA ($m^2/g$) is from $1.4\times10^3$ or about $1.4\times10^3$ to $5.0\times10^3$ or about $5.0\times10^3$ are used. The product (D50×SA) of the silica particles is preferably from $3.0\times10^3$ to $4.5\times10^3$, and is further preferably from $3.5\times10^3$ to $4.0\times10^3$. From the viewpoint of preventing the paper from being warped by improving the releasability of the toner layer at the time of the fixing, the product (D50×SA) of the silica particles is also preferably from $2.5\times10^3$ or about $2.5\times10^3$ to $4.0\times10^3$ or about $4.0\times10^3$. Note that, a unit of the product (D50×SA) is $\mu m\cdot m^2/g$.

The silica particles in which the product (D50×SA) is within the above range allow a specific surface area to be increased, which makes it easy to hold the moisture, the moisture rate of the toner is set to be within the above range, and thereby the dog ear is likely to be prevented. In addition, when the BET specific surface area with respect to the particle diameter is increased, the added amount of the external additives for obtaining the same specific surface area may be small, and the external additives coverage of the surface of the toner particle also may be made small. Since the external additives coverage of the toner surface may be made small, it is possible to prevent the surface layer of the toner from being hardened apparently. With this, it is presumed that the bleeding properties of the release agent with respect to the surface of the toner image at the time of the fixing are improved, the releasability of the toner is improved, and thus the paper is prevented from being warped, thereby preventing the occurrence of the dog ear.

The volume average particle diameter of the silica particles is preferably from 0.08 μm or about 0.08 μm to 0.30 μm or about 0.30 μm, and is further preferably from 0.10 μm or about 0.10 μm to 0.20 μm or about 0.20 μm from the viewpoint that the moisture rate of the toner is set to be within the above range, and the expansion and contraction of the paper is prevented at the time of fixing.

The volume average particle diameter of the silica particles is measured by the following method.

Specifically, a toner to which the external additives to be measured are externally added is prepared. The obtained toner is observed by using a scanning electron microscope (SEM) (S-4100: manufactured by Hitachi, Ltd.) so as to capture an image, and the captured image is analyzed by using an image analyzer (LUZEXIII: manufactured by NIRECO.), the area for each particle is measured by the image analyzing of the primary particles of the external additives, and a circle equivalent diameter is calculated from the value of measured area. The calculation of the circle equivalent diameter is performed on 100 external additives. Then, 50% diameter (D50) in the cumulative frequency of volume basis of the obtained circle equivalent diameter is set as a volume average particle diameter (an average equivalent circle diameter D50) of the external additives. Note that, the magnification of the electronic microscope is adjusted such that 10 to 50 of the silica particles are came out in a single view, and the circle equivalent diameter of the primary particle is obtained by combining the observation of the silica particles in plural views.

From the viewpoint of controlling the moisture amount in the paper evaporated at the time of the fixing by setting the moisture rate of the toner to be within the above range, the BET specific surface area SA of the silica particles is preferably from 20 $cm^2/g$ to 100 $cm^2/g$, and is further preferably from 30 $cm^2/g$ to 80 $cm^2/g$.

The BET specific surface area of the external additives is measured by using a nitrogen substitution method. Specifically, the BET specific surface area of the external additives is measured by using a three point method with an SA3100 specific surface area measuring device (manufactured by Beckman Coulter, Inc). Specifically, the BET specific surface area of the external additives is measured in such a manner that 5 g of external additives are added into a cell, a degassing treatment is performed at 60° C. for 120 minutes, and then the measurement is performed with a mixed gas of nitrogen and helium (volume ratio of 30:70).

Here, in a case where the external additives are not externally added to the toner particles, the toner particles are dispersed in water by using a surfactant and the like or using in combination thereof, if necessary, with respect to the toner particles, then the toner particles are subjected to an ultrasonic treatment (lower than 20° C., amplitude: 180 μm, 30 minutes) in water, and supernatants after sedimentation of the toner particles are collected and vacuum-dried. As a result, only external additives may be separated and collected. In a case where the surfactant and the like are used in combination, the toner is washed with pure water so as to remove the surfactant, and thus, the external additives are collected. After that, the volume average particle diameter and the BET specific surface area are measured by using the external additives separated from the toner particles.

The amount of the external additive is, for example, preferably from 0.01 weight % to 5 weight %, and is further preferably from 0.01 weight % to 2.0 weight % with respect to the toner particles.

Preparing Method of Toner

Next, the method of preparing the toner will be described.

The toner of the exemplary embodiment is obtained by additionally adding the external additive to the toner particles after preparing the toner particles.

The toner particles may be prepared by using any one of a drying method (for example, a kneading and pulverizing method) and a wetting method (for example, an aggregation and coalescence method, a suspension polymerization method, and a dissolution suspension method). The preparing method of the toner particles is not particularly limited, and well-known method may be employed.

Among them, the toner particles may be obtained by using the aggregation and coalescence method.

Specifically, for example, in a case where the toner particles (toner particles having a core•shell structure) in which the release agent abundance is within the above range are prepared by using an aggregation and coalescence method, the toner particles are prepared through the following steps: a step of preparing a resin particle dispersion for a core in which resin particles for a core which become a binder resin of the core are dispersed (a preparing step of a resin particle dispersion for a core); a step of preparing a resin particle dispersion for a shell layer in which resin particles for a shell layer which become a binder resin of a shell layer are dispersed (a preparing step of a resin particle dispersion for a shell layer); a step of preparing a release agent particle dispersion in which release agent particles are dispersed (a preparing step of a release agent particle dispersion); a step of forming a first aggregated particle by aggregating the resin particles for a core (if necessary, other particles are aggregated) in the resin particle dispersion for a core (in the dispersion in which if necessary, other particles dispersion for a core, such as a coloring agent are mixed) (a first aggregated particle forming step); a step of forming a second aggregated particle by mixing a first aggregated particle dispersion in which the first aggregated particles are dispersed, the resin particle dispersion for a shell layer, and the release agent particle dispersion, and aggregating the resin particles for a shell layer and release agent particles so as to be adhered to the surface of the first aggregated particle (a second aggregated particle forming step); and a step (a coalescence step) of coalescing the second aggregated particles by heating a second aggregated particle dispersion in which the second aggregated particles are dispersed so as to form toner particles.

Hereinafter, the respective steps of the aggregation and coalescence method will be described in detail. In the following description, a method of obtaining toner particles including the coloring agent will be described; however, the coloring agent is used if necessary. Other additives other than the coloring agent may also be used.

Dispersion Preparing Step

First, a resin particle dispersion for a core (a polyester resin particle dispersion), a resin particle dispersion for a shell layer (a polyester resin particle dispersion), a coloring agent particle dispersion, and a release agent particle dispersion are prepared.

Note that, hereinafter, each of the resin particle dispersions in which each of the resin particles are dispersed is referred to as a "resin particle dispersion".

Here, the resin particle dispersion is, for example, prepared by dispersing the resin particles in a dispersion medium with a surfactant.

An aqueous medium is used, for example, as the dispersion medium used in the resin particle dispersion.

Examples of the aqueous medium include water such as distilled water, ion exchange water, or the like, alcohols, and the like. The medium may be used singly or in combination of two or more kinds thereof.

Examples of the surfactant include anionic surfactants such as sulfate, sulfonate, phosphate, and soap anionic surfactants; cationic surfactants such as amine salt and quaternary ammonium salt cationic surfactants; and nonionic surfactants such as polyethylene glycol, alkyl phenol ethylene oxide adduct, and polyol. Among them, anionic surfactants and cationic surfactants are particularly preferable. Nonionic surfactants may be used in combination with anionic surfactants or cationic surfactants.

The surfactants may be used singly or in combination of two or more kinds thereof.

As a method of dispersing the resin particles in the dispersion medium, a common dispersing method by using, for example, a rotary shearing-type homogenizer, a ball mill having media, a sand mill, or a Dyno mill is exemplified. The resin particles may be dispersed in the dispersion medium by using, for example, a phase inversion emulsification method. The phase inversion emulsification method is a method of dispersing a resin in an aqueous medium in a particle form by dissolving a resin to be dispersed in a hydrophobic organic solvent in which the resin is soluble, conducting neutralization by adding a base to an organic continuous phase (O phase), and performing the phase inversion from W/O to O/W by adding an aqueous medium (W phase).

The volume average particle diameter of the resin particles dispersed in the resin particle dispersion is, for example, preferably from 0.01 μm to 1 μm, is further preferably from 0.08 μm to 0.8 μm, and is still further preferably from 0.1 μm to 0.6 μm.

Regarding the volume average particle diameter of the resin particles, a cumulative distribution by volume is drawn from the side of the smallest diameter with respect to particle diameter ranges (channels) separated using the particle diameter distribution obtained by the measurement of a laser diffraction-type particle diameter distribution measuring device (for example, manufactured by Horiba, Ltd., LA-700), and a particle diameter when the cumulative percentage becomes 50% with respect to the entire particles is set as a volume average particle diameter D50v. Note that, the volume average particle diameter of the particles in other dispersions is also measured in the same manner.

The content of the resin particles contained in the resin particle dispersion is preferably from 5% by weight to 50% by weight, and is further preferably of 10% by weight to 40% by weight.

The coloring agent particle dispersion and the release agent particle dispersion are also prepared in the same manner as in the case of the resin particle dispersion. That is, the dispersion medium, the volume average particle diameter of the particles, the dispersing method, and the content of the particles in the release agent particle dispersion are applicable to those in the coloring agent dispersion and the release agent particle dispersion.

First Aggregated Particle Forming Step

Next, the resin particle dispersion for the core and the coloring agent dispersion are mixed with each other. In addition, in the mixed dispersion, the resin particles for the core (polyester resin particles) and the coloring agent particles are heteroaggregated to form a first aggregated particle containing the resin particles for the core and coloring agent particles and having a targeted diameter. Note that, if necessary, the release agent particle dispersion may be also mixed thereinto such that the release agent particles are contained in the first aggregated particle.

Specifically, for example, an aggregating agent is added to the mixed dispersion and a pH of the mixed dispersion is adjusted to be acidic (for example, the pH is from 2 to 5). If necessary, a dispersion stabilizer is added. Then, the mixed dispersion is heated at a temperature close to a glass transition temperature of the resin particles for the core (specifically, for example, from (glass transition temperature—30° C.) to (glass transition temperature—10° C.) with respect to the resin particles for the core) to aggregate the particles dispersed in the mixed dispersion, thereby forming the aggregated particles.

In the first aggregated particle forming step, for example, the aggregating agent may be added at room temperature (for example, 25° C.) while stirring of the mixed dispersion using a rotary shearing-type homogenizer, the pH of the mixed dispersion may be adjusted to be acidic (for example, the pH is from 2 to 5), a dispersion stabilizer may be added if necessary, and then the heating may be performed.

Examples of the aggregating agent include a surfactant having an opposite polarity to the polarity of the surfactant used as the dispersant to be added to the mixed dispersion, an inorganic metal salt, and a divalent or more metal complex. In a case where a metal complex is used as the aggregating agent, the amount of the aggregating agent used is reduced and charging characteristics are improved. In addition to the aggregating agent, an additive for forming and a bond of metal ions of the aggregating agent and a complex or a similar bond may be used, if necessary. A chelating agent is suitably used as this additive.

Examples of the inorganic metal salt include metal salt such as calcium chloride, calcium nitrate, barium chloride, magnesium chloride, zinc chloride, aluminum chloride, and aluminum sulfate; and an inorganic metal salt polymer such as poly aluminum chloride, poly aluminum hydroxide, and calcium polysulfide.

As the chelating agent, an aqueous chelating agent may be used. Examples of the chelating agent include oxycarboxylic acid such as tartaric acid, citric acid, and gluconic acid; amino carboxylic acid such as iminodiacetic acid (IDA), nitrilotriacetic acid (NTA), and ethylenediaminetetraacetic acid (EDTA).

The additive amount of the chelating agent is, for example, preferably from 0.01 parts by weight to 5.0 parts by weight, and is further preferably equal to or greater than 0.1 parts by weight and less than 3.0 parts by weight, with respect to 100 parts by weight of resin particle.

Second Aggregated Particle Forming Step

After obtaining the first aggregated particle dispersion in which the first aggregated particles are dispersed, the first aggregated particle dispersion, the resin particle dispersion for a shell layer, and the release agent particle dispersion are further mixed with each other. The resin particle dispersion for a shell layer and the release agent particle dispersion are mixed in advance, and this mixed solution may be mixed into the first aggregated particle dispersion.

In addition, in the mixed dispersion, the resin particles for a shell layer and the release agent particles are heteroaggregated so as to be adhered to the surface of the first aggregated particle, and thus, a second aggregated particle having a diameter close to a targeted diameter of the toner particle is formed.

Specifically, for example, in the first aggregated particle forming step, when the first aggregated particle has reached the target particle diameter, a dispersion in which the resin particles for a shell layer and the release agent particles are dispersed is mixed into the first aggregated particle dispersion. Then, the obtained mixed dispersion is heated at a temperature which is equal to or lower than a glass transition temperature of the resin particles for a shell layer, pH of the mixed dispersion is set to be from 6.5 to 8.5, and the progress of aggregation is stopped.

With this, it is possible to obtain the second aggregated particle in which the resin particles for a shell layer and the release agent particles are aggregated so as to be adhered to the surface of the first aggregated particle.

Coalescence Step

Next, the second aggregated particle dispersion in which the second aggregated particles are dispersed is heated at, for example, a temperature that is equal to or higher than the glass transition temperature of the resin for a shell layer (for example, a temperature that is higher than the glass transition temperature of the resin for a shell layer by 10° C. to 50° C.) to perform the coalesce on the second aggregated particle and form toner particles.

The toner particles are obtained through the foregoing steps.

Note that, the toner particles may be prepared through a step of forming third aggregated particles in such a manner that a second aggregated particle dispersion in which the second aggregated particles are dispersed is obtained, then the second aggregated particle dispersion and a resin particle dispersion in which the resin particles corresponding to the binder resin are dispersed are mixed, and aggregated such that the resin particles are further adhered on the surface of the second aggregated particle; and a step of forming the toner particles by heating a third aggregated particle dispersion in which the third aggregated particles are dispersed, and coalescing the third aggregated particles.

After the coalescence step, the toner particles formed in the solution are subjected to a washing step, a solid-liquid separation step, and a drying step, that are well known, and thus dry toner particles are obtained.

In the washing step, displacement washing using ion exchange water may be sufficiently performed from the viewpoint of charging properties. In addition, the solid-liquid separation step is not particularly limited, but suction filtration, pressure filtration, or the like is preferably performed from the viewpoint of productivity. The method of the drying step is also not particularly limited, but freeze drying, airflow drying, fluidized drying, vibration-type fluidized drying, or the like may be performed from the viewpoint of productivity.

The toner according to the exemplary embodiment is prepared by adding and mixing, for example, an external additive to the obtained dry toner particles. The mixing may be performed with, for example, a V-blender, a HENSCHEL MIXER, a LODIGE MIXER, or the like. Furthermore, if necessary, coarse particles of the toner may be removed by using a vibration sieving machine, a wind classifier, or the like.

Electrostatic Charge Image Developer

The electrostatic charge image developer according to the exemplary embodiment includes at least the toner according to the exemplary embodiment.

The electrostatic charge image developer according to the exemplary embodiment may be a one-component developer which includes only the toner according to the exemplary embodiment, or may be a two-component developer in which the toner and a carrier are mixed with each other.

The carrier is not particularly limited, and a well-known carrier may be used. Examples of the carrier include a coating carrier in which the surface of the core formed of magnetic particle is coated with the coating resin; a magnetic particle dispersion-type carrier in which the magnetic particle are dispersed and distributed in the matrix resin; and a resin impregnated-type carrier in which a resin is impregnated into the porous magnetic particles.

Note that, the magnetic particle dispersion-type carrier and the resin impregnated-type carrier may be a carrier in which the forming particle of the carrier is set as a core and the core is coated with the coating resin.

Examples of the magnetic particle include a magnetic metal such as iron, nickel, and cobalt, and a magnetic oxide such as ferrite, and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, and a straight silicone resin formed by containing an organosiloxane bond or a modified product thereof, a fluorine resin, polyester, polycarbonate, a phenol resin, and an epoxy resin.

Note that, other additives such as the conductive particles may be contained in the coating resin and the matrix resin.

Examples of the conductive particle include particles of metal such as gold, silver, and copper, carbon black, titanium oxide, zinc oxide, tin oxide, barium sulfate, aluminum borate, and potassium titanate.

Here, in order to coat the surface of the core with the coating resin, a method of coating the surface with a coating layer forming solution in which the coating resin, and various external additives if necessary are dissolved in a proper solvent is used. The solvent is not particularly limited as long as a solvent is selected in consideration of a coating resin to be used and coating suitability.

Specific examples of the resin coating method include a dipping method of dipping the core into the coating layer forming solution, a spray method of spraying the coating layer forming solution onto the surface of the core, a fluid-bed method of spraying the coating layer forming solution to the core in a state of being floated by the fluid air, and a kneader coating method of mixing the core of the carrier with the coating layer forming solution and removing a solvent in the kneader coater.

The mixing ratio (weight ratio) of the toner to the carrier (toner:carrier) in the two-component developer is preferably from 1:100 to 30:100, and further preferably from 3:100 to 20:100.

Image Forming Apparatus/Image Forming Method

An image forming apparatus according to the exemplary embodiment and an image forming method will be described below.

The image forming apparatus according to the exemplary embodiment includes an image holding member, a charging unit that charges a surface of the image holding member, an electrostatic charge image forming unit that forms an electrostatic charge image on the charged surface of the image holding member, a developing unit that accommodates an electrostatic charge image developer, and develops the electrostatic charge image formed on the surface of the image holding member as a toner image with the electrostatic charge image developer, a transfer unit that transfers the toner image formed on the surface of the image holding member to the surface of a recording medium, and a fixing unit that fixes the toner image transferred to the surface of the recording medium. In addition, as an electrostatic charge image developer, the electrostatic charge image developer according to the exemplary embodiment is applied.

In the image forming apparatus according to the exemplary embodiment, an image forming method (the image forming method according to the exemplary embodiment) which includes a charging step of charging a surface of the image holding member, an electrostatic charge image forming step of forming an electrostatic charge image the charged surface of the image holding member, a developing step of developing an electrostatic charge image formed on the surface of the image holding member as a toner image with an electrostatic charge image developer according to the exemplary embodiment, a transfer step of transferring the toner image formed on the surface of the image holding member to a surface of a recording medium, a fixing step of fixing the toner image the transferred to the surface of the recording medium.

As the image forming apparatus according to the exemplary embodiment, well-known image forming apparatuses such as an apparatus including a direct-transfer type apparatus that directly transfers the toner image formed on the surface of the image holding member to the recording medium; an intermediate transfer type apparatus that primarily transfers the toner image formed on the surface of the image holding member to a surface of an intermediate transfer member, and secondarily transfers the toner image transferred to the intermediate transfer member to the surface of the recording medium; an apparatus including a cleaning unit that cleans the surface of the image holding member before being charged and after transferring the toner image; and an apparatus including an erasing unit that erases charges by irradiating the surface of the image holding member with erasing light before being charged and after transferring the toner image.

In a case where the intermediate transfer type apparatus is used, the transfer unit is configured to include an intermediate transfer member that transfers the toner image to the surface, a primary transfer unit that primarily transfers the toner image formed on the surface of the image holding member to the surface of the intermediate transfer member, and a secondary transfer unit the toner image formed on the surface of the intermediate transfer member is secondarily transferred to the surface of the recording medium.

In the image forming apparatus according to the exemplary embodiment, for example, a unit including the developing unit may be a cartridge structure (process cartridge) detachable from the image forming apparatus. As a process cartridge, for example, a process cartridge including the developing unit accommodating the electrostatic charge image developer in the exemplary embodiment is preferably used.

Hereinafter, an example of the image forming apparatus of the exemplary embodiment will be described; however, the invention is not limited thereto. Note that, in the drawing, major portions will be described, and others will not be described.

FIG. 1 is a configuration diagram illustrating an example of the image forming apparatus according to the exemplary embodiment.

The image forming apparatus as illustrated in FIG. 1 is provided with electrophotographic type first to fourth image forming units 10Y, 10M, 10C, and 10K (image forming unit) that output an image for each color of yellow (Y), magenta (M), cyan (C), and black (K) based on color separated image data. These image forming units 10Y, 10M, 10C, and 10K (hereinafter, simply referred to as a "unit" in some cases) are arranged apart from each other by a predetermined distance in the horizontal direction. Note that, the units 10Y, 10M, 10C, and 10K may be the process cartridge which is detachable from the image forming apparatus.

As an intermediate transfer member, an intermediate transfer belt 20 passing through the units is extended upward in the drawing of the respective units 10Y, 10M, 10C, and 10K. The intermediate transfer belt 20 is provided to be wound by a support roller 24 contacting a driving roller 22 and the inner surface of an intermediate transfer belt 20 which are disposed apart from each other in the horizontal direction in the drawing, and travels to the direction from the first unit 10Y to the fourth unit 10K. In addition, a force is applied to the support roller 24 in the direction apart from the driving roller 22 by a spring (not shown), and thus a tension is applied to the intermediate transfer belt 20 which is wound by both. Further, an intermediate transfer member cleaning device 30 is provided on the side surface of the image forming member of the intermediate transfer belt 20 so as to face the driving roller 22.

In addition, four colors toner of yellow, magenta, cyan, and black stored in toner cartridges 8Y, 8M, 8C, and 8K are correspondingly supplied to each of the developing devices (developing units) 4Y, 4M, 4C, and 4K of each of the units 10Y, 10M, 10C, and 10K.

The first to fourth units 10Y, 10M, 10C, and 10K have the same configuration as each other, and thus the first unit 10Y for forming a yellow image disposed on the upstream side the travel direction of the intermediate transfer belt will be representatively described. Note that, the description for the second to fourth units 10M, 10C, and 10K will be omitted by denoting reference numeral with magenta (M), cyan (C), and black (K) instead of yellow (Y) to the same part as that of the first unit 10Y.

The first unit 10Y includes a photoreceptor 1Y serving as an image holding member. In the vicinity of the photoreceptor 1Y, a charging roller (an example of the charging unit) 2Y which charges the surface of the photoreceptor 1Y with a predetermined potential, an exposure device (an example of the electrostatic charge image forming unit) 3 which exposes the charged surface by using a laser beam 3Y based on color separated image signal so as to form an electrostatic charge image, a developing device (an example of the developing unit) 4Y which supplies the charged toner to the electrostatic charge image and develops the electrostatic charge image, a primary transfer roller 5Y (an example of the primary transfer unit) which transfers the developed toner image onto the intermediate transfer belt 20, and a photoreceptor cleaning device (an example of the cleaning unit) 6Y which removes the residues remaining on the surface of the photoreceptor 1Y after primary transfer are sequentially disposed.

Note that, the primary transfer roller 5Y is disposed inside the intermediate transfer belt 20, and is provided at a position facing the photoreceptor 1Y. Further, a bias power supply (not shown) which is applied to the primary transfer bias is connected to each of the primary transfer rollers 5Y, 5M, 5C, and 5K. The bias power supply is changed to the transfer bias which is applied to applying to the primary transfer roller by control of a control unit (not shown).

Hereinafter, an operation of forming a yellow image in the first unit 10Y will be described.

First, before starting the operation, the surface of the photoreceptor 1Y is charged with a potential of from −600 V to −800 V by the charging roller 2Y.

The photoreceptor 1Y is formed by stacking the photosensitive layers on the conductive substrate (for example, volume resistivity of equal to or less than $1\times10^{-6}$ Ωcm at 20° C.). The photosensitive layer typically has high resistance (the resistance of the typical resin), but when being irradiated with a laser beam 3Y, it has the property of changing the resistivity of a portion which is irradiated with the laser beam. In this regard, in accordance with image data for yellow transmitted from the control unit (not shown), the laser beam 3Y is output via the exposure device 3 on the surface of the photoreceptor 1Y. The surface of the photoreceptor 1Y is irradiated with the laser beam 3Y, and with this, the electrostatic charge image of a yellow image pattern is formed on the surface of the photoreceptor 1Y.

The electrostatic charge image means an image formed on the surface of the photoreceptor 1Y by charging, and is a so-called negative latent image formed in such a manner that the resistivity of a portion of the photosensitive layer to be irradiated with the laser beam 3Y is decreased, and the charges for charging the surface of the photoreceptor 1Y flow, and the charges of a portion which is not irradiated with the laser beam 3Y remain.

The electrostatic charge image formed on the photoreceptor 1Y is rotated to the predetermined developing position in accordance with the traveling of the photoreceptor 1Y. Further, the electrostatic charge image on the photoreceptor 1Y is visualized (developed) in the developing position as a toner image by the developing device 4Y.

The developing device 4Y contains, for example, an electrostatic charge image developer including at least a yellow toner and a carrier. The yellow toner is frictionally charged by being stirred in the developing device 4Y to have a charge with the same polarity (negative polarity) as the charge that is charged on the photoreceptor 1Y, and is thus held on the developer roller (an example of the developer holding member). By allowing the surface of the photoreceptor 1Y to pass through the developing device 4Y, the yellow toner electrostatically adheres to the erased latent image part on the surface of the photoreceptor 1Y, whereby the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer, a primary transfer bias is applied to the primary transfer roller 5Y and an electrostatic force toward the primary transfer roller 5Y from the photoreceptor 1Y acts on the toner image, and thereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by a photoreceptor cleaning device 6Y.

The primary transfer biases that are applied to the primary transfer rollers 5M, 5C, and 5K of the second unit 10M and the subsequent units are also controlled in the same manner as in the case of the first unit.

In this manner, the intermediate transfer belt 20 onto which the yellow toner image is transported in the first unit 10Y is sequentially conveyed through the second to fourth units 10M, 10C, and 10K and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roller 24 contacting the inner surface of the intermediate transfer belt, and a secondary transfer roller (an example of the secondary transfer unit) 26 disposed on the image holding surface side of the intermediate transfer belt 20. In addition, a recording paper (an example of the recording medium) P is supplied to a gap between the secondary transfer roller 26 and the intermediate transfer belt 20, that contact each other, via a supply mechanism at a predetermined timing, and a secondary transfer bias is applied to the support roller 24. The transfer bias applied at this time has the same polarity (−) as the toner polarity (−), and an electrostatic force toward the recording paper P from the intermediate transfer belt 20 acts on the toner image, and thereby the toner image on the intermediate transfer belt 20 is transferred onto the recording paper P. In this case, the secondary transfer bias is determined depending on the resistance detected by a resistance detecting unit (not shown) that detects the resistance of the secondary transfer part, and is voltage-controlled.

Thereafter, the recording paper P is supplied to a nip portion of a pair of fixing roller in a fixing device (an example of the fixing unit) 28 so that the toner image is fixed to the recording paper P, and thus, a fixed image is formed.

Examples of the recording paper P for transferring the toner image include plain paper used in electrophotographic copying machines, printers, and the like. In addition to the recording paper P, examples of the recording medium also include an OHP sheet. In order to further improve the smoothness of the image surface after fixing, the surface of the recording paper P is also preferably smooth. For example, coated paper obtained by coating the surface of plain paper with a resin or the like, and art paper for printing are preferably used.

The recording paper P on which the fixing of the color image is completed is discharged toward a discharge part, and a series of the color image forming operations end.

Process Cartridge and Toner Cartridge

The process cartridge according to the exemplary embodiment will be described.

The process cartridge according to the exemplary embodiment is a process cartridge which is provided a developing unit that accommodates the electrostatic charge image developer according to the exemplary embodiment, and develops electrostatic charge image formed on the surface of the image holding member as a toner image with the electrostatic charge image developer, and is detachable from the image forming apparatus.

The process cartridge according to the exemplary embodiment is not limited to the above-described configuration, and may be configured to include a developing device, and as necessary, at least one selected from other units such as an image holding member, a charging unit, an electrostatic charge image forming unit, and a transfer unit.

Hereinafter, an example of the process cartridge according to this exemplary embodiment will be shown. However, the process cartridge is not limited thereto. Major parts shown in the drawing will be described, but descriptions of other parts will be omitted.

Figure 2:
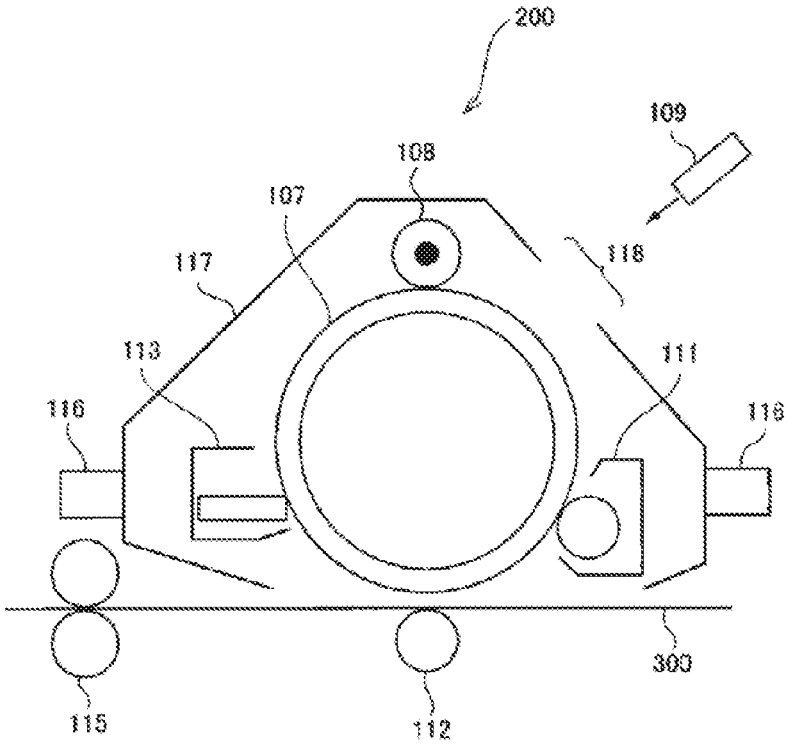
FIG. 2 is a configuration diagram illustrating an example of a process cartridge according to the exemplary embodiment.

FIG. 2 is a configuration diagram illustrating the process cartridge according to the exemplary embodiment.

A process cartridge 200 illustrated FIG. 2 is configured such that a photoreceptor (an example of the image holding member) 107, and a charging roller (an example of the charging unit) 108, a developing device (an example of the developing unit) 111, and a photoreceptor cleaning device (an example of the cleaning unit) 113 which are provided in the circumference of the photoreceptor 107 are integrally combined and held by a housing 117 provided with a mounting rail 116 and an opening 118 for exposure, thereby forming a cartridge.

In addition, in FIG. 2, a reference numeral 109 represents an exposure device (an example of the electrostatic charge image forming unit), a reference numeral 112 represents a transfer device (an example of the transfer unit), a reference numeral 115 represents a fixing device (an example of the fixing unit), and a reference numeral 300 represents a recording paper (an example of the recording medium).

Next, the toner cartridge according to the exemplary embodiment will be described.

The toner cartridge according to the exemplary embodiment is a toner cartridge that accommodates the toner according to the exemplary embodiment and is detachable from the image forming apparatus. The toner cartridge is to accommodate a toner for replenishment which is supplied to the developing unit provided in the image forming apparatus.

Note that, the image forming apparatus as illustrated in FIG. 1 is an image forming apparatus having a configuration in which toner cartridges 8Y, 8M, 8C, and 8K are detachable, and each of developing devices 4Y, 4M, 4C, and 4K is connected to the toner cartridge corresponding to each developing device (color) through a toner supply tube (not shown). In addition, in a case where the amount of the toners accommodated in the toner cartridge is decreased, the toner cartridge is replaced.

EXAMPLES

Hereinafter, the exemplary embodiment will be described in detail using Examples and Comparative examples. However, the exemplary embodiment is not limited to the following examples. In the following description, unless specifically noted, "parts" and "%" are based on the weight.

Preparation of Amorphous Polyester Resin Dispersion

Preparation of Polyester Resin Dispersion (APE1)

Terephthalic Acid: 90 Parts

Sodium-5-sulfoisophthalate: 1 part

Ethylene glycol: 70 parts

Neopentyl glycol: 30 parts 3 parts in total of the above components are put into a flask equipped with a stirrer, a nitrogen introduction tube, a temperature sensor, and a rectifying column, a temperature is raised to 190° C. over one hour, and a catalyst Ti $(OBu)_4$ (0.003% by weight of titanium tetrabutoxide with respect to the total amount of polyvalent carboxylic acid components) is poured into the mixture after confirming that the reaction system is stirred.

In addition, the temperature is slowly raised to 245° C. from 190° C. while removing generated water and a dehydration condensation reaction is continued for 6 hours to perform polymerization. After that, the temperature is lowered to 235° C., and a reaction is performed for 2 hours under the reduced pressure of 30 mmHg, thereby obtaining a polyester resin. The polyester resin has a weight average molecular weight of $73.0\times10^3$, a number average molecular weight of $5.1\times10^3$, and a glass transition temperature of 57.1° C.

Then, the obtained polyester resin is dispersed by using a dispersion machine in which CAVITRON CD1010 (manufactured by Eurotec, Ltd.) is modified to a high temperature and high pressure type. The CAVITRON is operated under the conditions that a pH of the composition of 80% of ion exchange water and 20% of polyester resin concentration is adjusted to 8.5 by ammonia, a rotating speed of a rotator is 60 Hz and a pressure is 5 kg/cm$^2$, a heating temperature by a heat exchanger is 140° C., and thus, a polyester resin dispersion (solid content of 20%) is obtained.

The volume average particle diameter of the resin particles in the dispersion is 130 nm. The solid content is adjusted to 20% by adding the ion exchange water to the dispersion, and this dispersion is designated as a polyester resin particle dispersion (APE1).

Preparation of Polyester Resin Dispersions (APE2), (APE3), (APE6) to (APE8), and (APE11) to (APE13)

Polyester resin dispersions (APE2), (APE3), (APE6) to (APE8), and (APE11) to (APE13) are obtained in the same manner as in the case of the polyester resin dispersion (APE1) except that kinds and the number of the polyol are changed as indicated in Tables 1 and 2.

Preparation of Coloring Agent Dispersion Preparation of Coloring Agent Particle Dispersion (Black Pigment Dispersion)

Carbon black (Regal330 prepared by Cabot Corporation.): 250 parts

Anionic surfactant (NEOGEN SC prepared by Daiichi Kogyo Seiyaku Co., Ltd.): 33 parts (effective component of 60%, 8% with respect to coloring agent)

Ion exchange water: 750 parts 280 parts of ion exchange water and 33 parts of anionic surfactant are put into a stainless steel container having a size such that the height of the liquid surface is about ⅓ of the height of the container when putting all of the above materials therein, a surfactant is sufficiently dissolved therein, then all of the carbon blacks are put into the container, and the mixture is stirred with a stirrer until there is no pigment which is not wet while sufficiently defoaming. After defoaming, the remaining ion exchange water is added, the mixture is dispersed for 10 minutes at 5,000 rpm by using a homogenizer (ULTRA TURRAX T50 manufactured by IKA Ltd), and the mixture is defoamed by being stirred overnight with the stirrer. After defoaming, the mixture is dispersed again for 10 minutes at 6,000 rpm by using a homogenizer and then is defoamed by being stirred overnight with the stirrer. Subsequently, the dispersion is dispersed at a pressure of 240 MPa by using a high pressure impact type dispersing machine Ultimizer (HJP30006: manufactured by Sugino Machine Limited Co., Ltd). The dispersion is performed 25 times in terms of the total amount of the materials charged and the processing capacity of the apparatus. The obtained dispersion is allowed to stand for 72 hours to remove a precipitate and ion exchange water is added to adjust the solid content to 15%, and thus, a coloring agent particle dispersion is obtained. The volume average particle diameter of the particles in the coloring agent particle dispersion D50 is 135 nm.

Preparation of Release Agent Dispersion

Preparation of Release Agent Dispersion (WAX1)

Paraffin wax (Product name "FNP090 (prepared by Nippon Seiro Co., Ltd.)", melting temperature of 90° C.): 270 parts Anionic surfactant (NEOGEN RK prepared by Daiichi Kogyo Seiyaku Co., Ltd.): 13.5 parts (effective component of 60%, 3.0% with respect to release agent)

Ion exchange water: 21.6 parts

The above-described materials are mixed, the release agent is dissolved at an inner liquid temperature of 120° C. by using a pressure discharge type homogenizer (Gaulin homogenizer manufactured by Gaulin, Inc.), then a dispersing treatment is preformed at a dispersion pressure of 5 MPa for 120 minutes and further at 40 MPa for 360 minutes, and cooling is performed so as to obtain a release agent dispersion (WAX1). The volume average particle diameter D50 of the particles in the release agent dispersion (WAX1) is 225 nm. After that, the ion exchange water is added so as to adjust the solid content to 20.0%.

Preparation of Release Agent Dispersion (WAX2)

A release agent dispersion (WAX2) is obtained in the same manner as in the case of the release agent dispersion (WAX1) except that terminal carboxylic acid synthetic ester wax (ester waxes: Product name "BLACK BUCKS 300-6S (prepared by Nippon Kasei Chemical Co., Ltd)" having a melting temperature of 95° C.) is used instead of the paraffin wax.

Preparation of Release Agent Dispersion (WAX3)

A release agent dispersion (WAX3) is obtained in the same manner as in the case of the release agent dispersion (WAX1) except that the polyester wax (hydrocarbon wax: Product name "PW725 (prepared by Baker Petrolite Corporation.)" having a melting temperature of 104° C.) is used instead of the paraffin wax.

Preparation of Mixed Particle Dispersion

Preparation of Mixed Particle Dispersion (RW1)

150 parts of polyester resin particle dispersion (APE1), 20 parts of release agent particle dispersion (WAX1), and 2.9 parts of anionic surfactant (DOWFAX2A1 prepared by Dow Chemical Japan Limited) are mixed with each other, and 1.0% of nitric acid is added to the mixture under the temperature of 25° C. so as to adjust pH to 3.0, thereby obtaining a mixed particle dispersion (RW1).

Preparation of Mixed Particle Dispersions (RW2) to (RW13)

Mixed particle dispersions (RW2) and (RW13) are obtained in the same manner as in the case of the mixed particle dispersion (RW1) except that the polyester resin particle dispersion and the release agent particle dispersion are combined with each other as indicated in Table 1.

Example 1

Polyester resin particle dispersion (APE1): 700 parts

Coloring agent particle dispersion: 133 part

Ion exchange water: 400 parts

Anionic surfactant (DOWFAX2A1 prepared by Dow Chemical Japan Limited): 2.9 parts The above materials are put into a 3 liter reaction vessel equipped with a thermometer, a pH meter, and a stirrer, 1.0% of nitric acid is added to the mixture at a temperature of 25° C. to adjust the pH to 3.0, and then 130 parts of an aluminum sulfate aqueous solution having a concentration of 2% is added and dispersed for six minutes while stirring at 5,000 rpm with a homogenizer (ULTRA TURRAX T50, manufactured by IKA Co., Ltd).

After that, a stirrer and a mantle heater are installed in the reaction vessel, the temperature is raised at a rate of 0.2° C./min up to a temperature of 40° C. and the temperature is raised at a rate of temperature rise of 0.05° C./min in a temperature range of higher than 40° C. while adjusting the rotation speed of the stirrer such that the slurry is sufficiently stirred, and the particle diameter is measured every ten minutes by using COULTER MULTISIZER II (aperture diameter of 50 μm, manufactured by Beckman Coulter, Inc). When the volume average particle diameter is 5.0 μm, the temperature is kept, and 450 parts of mixed particle dispersion (RW1) is put into the reaction vessel over five minutes.

After keeping the temperature for 30 minutes, 1% of sodium hydroxide aqueous solution is added so as to control the pH to 9.0. Thereafter, the temperature is raised up to 90° C. at a heating rate of 1° C./min while adjusting the pH to 9.0 as described above at every 5° C., and then the temperature is kept at 98° C. The particle shape and the surface property are observed with an optical microscope and a field emission type scanning electron microscope (FE-SEM), and it is confirmed that the particles are coalesced at tenth hour, so that the vessel is cooled down to 30° C. with cooling water over five minutes.

The cooled slurry is allowed to pass through a nylon mesh having an opening of 15 μm to remove coarse powder, and the toner slurry that has passed through the mesh is filtered under reduced pressure with an aspirator. The toner remaining on the filter paper is pulverized as finely as possible by hand, and then is put into ion exchange water at 10 times the toner at a temperature of 30° C., and the mixture is stirred for 30 minutes. Then, the toner slurry is filtered under the reduced pressure with the aspirator, the toner remaining on the filter paper is pulverized as finely as possible by hand, and put into ion exchange water at 10 times the toner at a temperature of 30° C., the mixture is stirred for 30 minutes, after that, filtering is performed again under the reduced pressure with the aspirator, and the electric conductivity of the filtrate is measured. This operation is repeatedly performed until the electric conductivity of the filtrate is 10 μS/cm or less, and the toner is washed.

The washed toner is pulverized finely by using a wet and dry type particle size regulator (COMIL) and is vacuum-dried in an oven at 35° C. for 36 hours, and thus, toner particles are obtained.

Preparation of External Additives

Preparation of Silica Particles (S1)

Preparation Step (Preparation of Alkaline Catalyst Solution)

250 parts of methanol and 50 parts of 10% ammonia aqueous solution are put into a glass reaction container equipped with a stirring blade, a dropping nozzle, and a thermometer, and the mixture is stirred to obtain an alkaline catalyst solution.

Particle Forming Step

Preparation of Silica Particle Suspension

Supplying Step

Next, the temperature of the alkaline catalyst solution is adjusted to 30° C., and the alkaline catalyst solution is subjected to substitution with nitrogen. Thereafter, while stirring the alkaline catalyst solution at 120 rpm, tetramethoxysilane (TMOS) and ammonia aqueous solution having a catalyst ($NH_3$) concentration of 3.7% are added dropwise at a flow rate of 4 parts/min and 2.4 parts/min, respectively, and at the same time, supply is performed, and when the tetramethoxysilane (TMOS) have reached 180 parts and the ammonia aqueous solution having the catalyst ($NH_3$) concentration of 3.7% have reached 10 parts, the supply is stopped, and thus, a silica particle suspension is obtained.

Removing and Drying Solvent

Thereafter, 300 parts of solvent of the obtained silica particle suspension are distilled off by heating, and 300 parts of pure water are added, followed by drying with a freeze dryer to obtain silica particles having a volume average particle diameter D50 of 120 nm.

Surface Treatment 100 parts of silica particles are floated in a gas phase and 50 parts of toluene solution containing 10% of HMDS (hexamethyl disilazane) is sprayed according to a spray drying method so as to perform a surface treatment of silica particles. After the surface treatment, the surface-treated silica particles are immersed into ethanol and then the ethanol is distilled off so as to prepare silica particles (S1).

Thereafter, 3.3 parts of silica particles (S1) is added as external additives with respect to 100 parts of the toner particles. Next, the components are mixed in a Henschel mixer for 3 minutes at a peripheral speed of 30 m/s. After that, the mixture is sieved with a vibration sieve having an opening of 45 μm so as to obtain a toner in Example 1.

Examples 2 and 3

Toners are obtained in the same manner as in the case of the toner in Example 1 except that kinds of the polyester resin particle dispersion and the mixed particle dispersion are changed as indicated in Table 1.

Example 4

A toner is obtained in the same manner as in the case of the toner in Example 2 except that the toner drying condition is changed to 40° C. for 72 hours and the amount of the silica particles (S1) is changed to be 2.0 parts.

Example 5

A toner is obtained in the same manner as in the case of the toner in Example 3 except that the toner drying condition is changed to 30° C. for 24 hours.

Examples 6 to 8

Toners are obtained in the same manner as in the case of the toner in Example 1 except that kinds of the polyester resin particle dispersion and the mixed particle dispersion are changed as indicated in Table 1.

Here, in Examples 6 and 7, the release agent dispersion indicated in Table 1 is used together with the polyester resin particle dispersion, as a core forming dispersion.

Example 9

A toner is obtained in the same manner as in the case of the toner in Example 1 except that the polyester resin particle dispersion (APE1) is changed to the polyester resin particle dispersion (APE6), and the silica particles (S1) are changed to silica particles (2) "RX50 (prepared by Nippon Aerosil Co., Ltd.: the volume average particle diameter D50=40 nm, BET specific surface area SA (indicated as BET in Tables)=35 $m^2/g$)".

Example 10

A toner is obtained in the same manner as in the case of the toner in Example 1 except that silica particles (S3) obtained by changing the preparing conditions of the silica particles (S1) such that 250 parts of methanol, 30.0 parts of 10% ammonia aqueous solution, and the temperature of the alkaline catalyst solution of 24° C. are applied.

Example 11

A toner is obtained in the same manner as in the case of the toner in Example 1 except that the mixed particle dispersion (RW1) is changed to a mixed particle dispersion (PW8) (PW725, prepared by Baker Petrolite Corporation).

Example 12

A toner is obtained in the same manner as in the case of the toner in Example 1 except that the silica particles (S1) are changed to silica particles (S5) "QSG30 (prepared by Shin-Etsu Chemical Co., Ltd.: the volume average particle diameter D50=30 nm, BET specific surface area SA (indicated as BET in Tables)=143 $m^2/g$)".

Examples 13 and 14

Toners are obtained in the same manner as in the case of the toner in Example 1 except that kinds of the polyester resin particle dispersion and the mixed particle dispersion are changed as indicated in Table 1.

Example 15

A toner is obtained in the same manner as in the case of the toner in Example 1 except kinds of the polyester resin particle dispersion and the mixed particle dispersion are changed as indicated in Table 1, the toner drying conditions are changed to 30° C. for 24 hours and silica particles (S4) obtained by changing the preparing conditions of the silica particles (S1) such that 250 parts of methanol, 24.0 parts of 10% ammonia aqueous solution, and the temperature of the alkaline catalyst solution of 22° C. are applied.

Comparative Examples 1 and 2

Toners are obtained in the same manner as in the case of the toner in Example 1 except that kinds of the polyester resin particle dispersion and the mixed particle dispersion are changed as indicated in Table 1.

Comparative Example 3

A toner is obtained in the same manner as in the case of the toner in Comparative Example 1 except that the added amount of silica particles (S1-S) in which the amount of the toluene solution containing 10% of HMDS (hexamethyl disilazane) is changed to be 25 parts is set to 6.0 parts in the surface treatment step of preparing the silica particles (S1).

Comparative Example 4

A Toner is obtained in the same manner as in the case of the toner in Example 1 except that kinds of the polyester resin particle dispersion and the mixed particle dispersion are changed as indicated in Table 1.

Comparative Example 5

A toner is obtained in the same manner as in the case of the toner in Example 1 except that the silica particles (S1) are changed to silica particles (S6) "QCB100 (prepared by Shin-Etsu Chemical Co., Ltd.: the volume average particle diameter D50=200 nm, BET specific surface area SA (indicated as BET in Tables)=27 $m^2/g$)".

Comparative Example 6

A toner is obtained in the same manner as in the case of the toner in Example 1 except that the silica particles (S1) are changed to silica particles (S7) "NY50 (prepared by Nippon Aerosil Co., Ltd.: the volume average particle diameter D50=40 nm, BET specific surface area SA (indicated as BET in Tables)=30 $m^2/g$)".

Measurement

With respect to the toner obtained in each Example, the moisture rate of the toner after being kept at 28° C. and 85% RH for 24 hours, an abundance ratio of the release agent, and a domain diameter (domain average diameter) of the releasing agent are measured according to the method described above.

Evaluation

Preparation of Developer 36 parts of toner in each Example and 414 parts of carrier are put into a 2 liter of V blender, stirred for 20 minutes, then sieved with a sieve mesh of 212 μm to prepare each developer. Here, a resin coated carrier described below is used.

Preparation of Resin Coated Carrier

Mn—Mg—Sr ferrite particles (average particle diameter of 40 μm): 100 parts

Toluene: 14 parts

Polymethylmethacrylate: 2.0 parts

Carbon black (VXC72: prepared by Cabot Corporation.): 0.12 parts

The above components, except for the ferrite particles, and glass beads (φ 1 mm, same amount as toluene) are stirred for 30 minutes at 1,200 rpm using a sand mill manufactured by KANSAI PAINT Co., Ltd. so as to obtain a resin coating layer forming solution. Further, this resin coating layer forming solution and ferrite particles are put into a vacuum deaeration type kneader, the pressure is reduced, toluene is distilled off, and the resultant is dried, returned to room temperature, and sieved with a sieve mesh of 212 μm. Through this step, a resin coated carrier is prepared.

Evaluation of Dog Ear

The developing unit of the image forming apparatus "DocuCentre-V 3060 manufactured by Fuji Xerox Co., Ltd." is filled with a developer of each example. Then, it is kept for 24 hours under the environment of 28° C. and 85% RH, and paper containing water (size of 11×17 in inch, Premier 80 paper) is placed in the image forming apparatus.

With such an image forming apparatus, 500 sheets of the water-containing paper in which an image having an image density of 100% and a size of a whole length in the photoreceptor axial direction and 10 cm in the photoreceptor circumferential direction is formed on both sides of the paper with a paper edge margin width of 2 mm is printed under the environment of 28° C. and 85% RH. The frequency of occurrence of the dog ear (corner folded at a paper edge) is evaluated according to the following evaluation criteria.

Evaluation Criteria

A: Dog ear (corner folded at paper edge) has not occurred

B: Number of papers having occurrences of dog ear (corner folded at paper edge) is from 1 to 3

C: Number of papers having occurrences of dog ear (corner folded at paper edge) is from 4 to 10

D: The number of papers having occurrences of dog ear (corner folded at paper edge) is 11 or more.

Hereinafter, details of Example and Comparative Example will be listed below in Tables 1 and 2.

Abbreviations and the like in Tables 1 and 2 are as follows.

Section of Polyol 1

Bisphenol A:

Bisphenol A ethylene oxide adduct (the number of average additional moles 2.1)

TABLE 1

| | Toner particles | | | | | | | | | | | | | | | |
|---|---|---|---|---|---|---|---|---|---|---|---|---|---|---|---|---|
| | Polyester resin particle dispersion (core forming dispersion) | | | | | Release agent dispersion (core forming dispersion) | | Mixed particle dispersion (shell forming resin particle dispersion) | | | | | Release agent | | Dry | |
| | | Polyol 1 | | Polyol 2 | | | | | Polyester resin particle dispersion | | Release agent dispersion | | Release agent abundance | Domain diameter of release agent | Temperature | |
| | Types | Types | parts | Types | parts | Types | parts | Types | Types | parts | Types | parts | (%) | (μm) | | Time |
| Example 1 | APE1 | Ethylene glycol | 70 | Neopentyl glycol | 30 | None | | RW1 | APE1 | 150 | WAX1 | 20 | 85 | 0.6 | 35 | 36 |
| Example 2 | APE2 | Ethylene glycol | 40 | Propylene glycol | 60 | None | | RW2 | APE2 | 150 | WAX1 | 20 | 85 | 0.6 | 35 | 36 |
| Example 3 | APE3 | Ethylene glycol | 90 | Neopentyl glycol | 10 | None | | RW3 | APE3 | 150 | WAX1 | 20 | 85 | 0.6 | 35 | 36 |
| Example 4 | APE2 | Ethylene glycol | 40 | Propylene glycol | 60 | None | | RW2 | APE2 | 150 | WAX1 | 20 | 85 | 0.6 | 40 | 72 |
| Example 5 | APE3 | Ethylene glycol | 90 | Neopentyl glycol | 10 | None | | RW3 | APE1 | 150 | WAX1 | 20 | 85 | 0.6 | 30 | 24 |

TABLE 1-continued

| | Toner particles | | | | | | | | | | | | | | | |
|---|---|---|---|---|---|---|---|---|---|---|---|---|---|---|---|---|
| | Polyester resin particle dispersion (core forming dispersion) | | | | | Release agent dispersion (core forming dispersion) | | Mixed particle dispersion (shell forming resin particle dispersion) | | | | | Release agent | | Dry | |
| | | Polyol 1 | | Polyol 2 | | | | | Polyester resin particle dispersion | | Release agent dispersion | | Release agent abundance | Domain diameter of release agent | Temperature | |
| | Types | Types | parts | Types | parts | Types | parts | Types | Types | parts | Types | parts | (%) | (μm) | | Time |
| Example 6 | APE1 | Ethylene glycol | 70 | Neopentyl glycol | 30 | WAX1 | 4 | RW5 | APE1 | 150 | WAX1 | 16 | 70 | 0.5 | 35 | 36 |
| Example 7 | APE1 | Ethylene glycol | 70 | Neopentyl glycol | 30 | WAX1 | 8 | RW6 | APE1 | 150 | WAX1 | 12 | 65 | 0.7 | 35 | 36 |
| Example 8 | APE1 | Ethylene glycol | 70 | Neopentyl glycol | 30 | None | | RW7 | APE1 | 150 | WAX2 | 20 | 85 | 0.7 | 35 | 36 |
| Example 9 | APE6 | Ethylene glycol | 70 | Butanediol | 30 | None | | RW1 | APE1 | 150 | WAX1 | 20 | 85 | 0.6 | 35 | 36 |
| Example 10 | APE1 | Ethylene glycol | 70 | Neopentyl glycol | 30 | None | | RW1 | APE1 | 150 | WAX1 | 20 | 85 | 0.6 | 35 | 36 |
| Example 11 | APE1 | Ethylene glycol | 70 | Neopentyl glycol | 30 | None | | RW8 | APE1 | 150 | WAX3 | 20 | 85 | 0.6 | 35 | 36 |
| Example 12 | APE1 | Ethylene glycol | 70 | Neopentyl glycol | 30 | None | | RW1 | APE1 | 150 | WAX1 | 20 | 85 | 0.6 | 35 | 36 |
| Example 13 | APE7 | Ethylene glycol | 80 | Neopentyl glycol | 20 | None | | RW9 | APE7 | 150 | WAX1 | 12 | 85 | 0.6 | 35 | 36 |
| Example 14 | APE8 | Ethylene glycol | 60 | Neopentyl glycol | 40 | None | | RW10 | APE8 | 150 | WAX1 | 12 | 85 | 0.6 | 35 | 36 |
| Example 15 | APE3 | Ethylene glycol | 90 | Neopentyl glycol | 10 | None | | RW3 | APE3 | 150 | WAX1 | 20 | 85 | 0.6 | 30 | 24 |
| Comparative Example 1 | APE11 | Bisphenol A | 70 | Neopentyl glycol | 30 | None | | RW11 | APE11 | 150 | WAX1 | 20 | 85 | 0.6 | 35 | 36 |
| Comparative Example 2 | APE12 | Ethylene glycol | 30 | Neopentyl glycol | 70 | None | | RW12 | APE12 | 150 | WAX1 | 20 | 85 | 0.6 | 35 | 36 |
| Comparative Example 3 | APE11 | Bisphenol A | 70 | Neopentyl glycol | 30 | None | | RW11 | APE11 | 150 | WAX1 | 20 | 85 | 0.6 | 30 | 24 |
| Comparative Example 4 | APE13 | Ethylene glycol | 95 | Neopentyl glycol | 5 | None | | RW13 | APE13 | 150 | WAX1 | 20 | 85 | 0.6 | 35 | 36 |
| Comparative Example 5 | APE1 | Ethylene glycol | 70 | Neopentyl glycol | 30 | None | | RW1 | APE1 | 150 | WAX1 | 20 | 85 | 0.6 | 35 | 36 |
| Comparative Example 6 | APE1 | Ethylene glycol | 70 | Neopentyl glycol | 30 | None | | RW1 | APE1 | 150 | WAX1 | 20 | 85 | 0.6 | 35 | 36 |

TABLE 2

| | External additives | | | | | | |
|---|---|---|---|---|---|---|---|
| | | Added | Properties | | | Moisture rate | Situation |
| | Types | amount (parts) | D50 (nm) | BET ($m^2/g$) | D50 × BET [$\times 10^3$] | of toner (%) | of occurrence of dog ear |
| Example 1 | S1 | 3.3 | 120 | 27.6 | 3.3 | 4.1 | A |
| Example 2 | S1 | 3.3 | 120 | 27.6 | 3.3 | 3.6 | B |
| Example 3 | S1 | 3.3 | 120 | 27.6 | 3.3 | 6.2 | B |
| Example 4 | S1 | 2.0 | 120 | 27.6 | 3.3 | 3.1 | C |
| Example 5 | S1 | 3.3 | 120 | 27.6 | 3.3 | 8 | C |
| Example 6 | S1 | 3.3 | 120 | 27.6 | 3.3 | 4.5 | B |
| Example 7 | S1 | 3.3 | 120 | 27.6 | 3.3 | 4.3 | C |
| Example 8 | S1 | 3.3 | 120 | 27.6 | 3.3 | 4.3 | C |
| Example 9 | S2 | 3.3 | 40 | 35 | 1.4 | 4.1 | C |
| Example 10 | S3 | 3.3 | 80 | 36.2 | 2.9 | 4.3 | B |
| Example 11 | S1 | 3.3 | 120 | 27.6 | 3.3 | 4.4 | B |
| Example 12 | S5 | 3.3 | 30 | 143 | 4.3 | 4.1 | C |
| Example 13 | S1 | 3.3 | 120 | 27.6 | 3.3 | 5.2 | B |
| Example 14 | S1 | 3.3 | 120 | 27.6 | 3.3 | 4.6 | B |
| Example 15 | S4 | 6 | 65 | 40.0 | 2.6 | 8.2 | C |
| Comparative Example 1 | S1 | 3.3 | 120 | 27.6 | 3.3 | 1.2 | D |
| Comparative Example 2 | S1 | 3.3 | 120 | 27.6 | 3.3 | 2.8 | D |
| Comparative Example 3 | S1-S | 6.0 | 120 | 27.6 | 3.3 | 2.5 | D |
| Comparative Example 4 | S1 | 3.3 | 120 | 27.6 | 3.3 | 7 | D |
| Comparative Example 5 | S6 | 3.3 | 200 | 27 | 5.4 | 4.1 | D |
| Comparative Example 6 | S7 | 3.3 | 40 | 30 | 1.2 | 4.1 | D |

From the above results, it is understood that in Examples, the occurrence of the dog ear (corner folded at a paper edge) is prevented as compared with Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles that contain an amorphous polyester resin which includes a condensed polymer of a polyvalent carboxylic acid and a polyol which contains ethylene glycol in an amount of from 40% by weight to 90% by weight with respect to a total amount of the polyol; and an external additive that contains silica particles in which a product of a volume average particle diameter D50 (nm) and a BET specific surface area SA ($m^2/g$) is from $1.4\times10^3$ to $5.0\times10^3$, wherein a moisture rate of the toner after being kept for 24 hours at 28° C. and 85% RH is from 3% by weight to 8% by weight, the volume average particle diameter (D50) of the silica particles is from 0.03 μm to 0.3 μm, and a ratio of the amorphous polyester resin to an entirety of a binder resin contained in the toner particles is 85% by weight or more.

2. The electrostatic charge image developing toner according to claim 1, wherein the moisture rate of the toner after being kept for 24 hours at 28° C. and 85% RH is from 4% by weight to 6% by weight.

3. The electrostatic charge image developing toner according to claim 1, wherein the toner particles contain a release agent, and 70% or more of an entirety of the release agent present in the toner particle is present within 800 nm from a surface of the toner particle.

4. The electrostatic charge image developing toner according to claim 3, wherein the release agent is a paraffin wax.

5. The electrostatic charge image developing toner according to claim 1, wherein the silica particles are silica particles in which the product of a volume average particle diameter D50 (nm) and a BET specific surface area SA ($m^2/g$) is from $2.5\times10^3$ to $4.0\times10^3$.

6. The electrostatic charge image developing toner according to claim 1, wherein the volume average particle diameter of the silica particles is from 0.08 μm to 0.30 μm.

7. The electrostatic charge image developing toner according to claim 1, wherein the volume average particle diameter of the silica particles is from 0.10 μm to 0.20 μm.

8. The electrostatic charge image developing toner according to claim 3, wherein an average diameter of domains of the release agent is from 0.3 μm to 0.8 μm.

9. The electrostatic charge image developing toner according to claim 3, wherein an average diameter of domains of the release agent is from 0.3 μm to 0.7 μm.

10. The electrostatic charge image developing toner according to claim 3, wherein an average diameter of domains of the release agent is from 0.3 μm to 0.5 μm.

11. An electrostatic charge image developer comprising the electrostatic charge image developing toner according to claim 1.

12. The electrostatic charge image developing toner according to claim 1, wherein the polyol further comprises an aliphatic diol selected from the group consisting of diethylene glycol, triethylene glycol, propylene glycol, butanediol, hexanediol, and neopentyl glycol.

13. The electrostatic charge image developing toner according to claim 1, wherein the polyol further comprises an alicyclic diol.

14. The electrostatic charge image developing toner according to claim 1, wherein the polyol further comprises one selected from the group consisting of an ethylene oxide adduct of bisphenol A, and a propylene oxide adduct of bisphenol A.

15. The electrostatic charge image developing toner according to claim 1, wherein the polyol further comprises an aromatic diol.

16. The electrostatic charge image developing toner according to claim 1, wherein polyol further comprises one selected from the group consisting of cyclohexanediol, cyclohexane dimethanol, and hydrogenated bisphenol A.

17. The electrostatic charge image developing toner according to claim 1, wherein the ratio of the amorphous polyester resin to the entirety of the binder resin contained in the toner particles is 95% by weight or more.

18. The electrostatic charge image developing toner according to claim 1, wherein the ratio of the amorphous polyester resin to the entirety of the binder resin contained in the toner particles is 100% by weight.

19. A toner cartridge comprising:

a container that contains the electrostatic charge image developing toner according to claim 1, wherein the toner cartridge is detachable from an image forming apparatus.

* * * * *